US006088970A

United States Patent [19]

Doran

[11] Patent Number: 6,088,970

[45] Date of Patent: Jul. 18, 2000

[54] LIGHT BUILDING ASSEMBLY SYSTEM

[76] Inventor: Rodney Garnet Doran, R.R. #1, Beeton, Ontario, Canada, L0G 1A0

[21] Appl. No.: 09/176,088

[22] Filed: Oct. 21, 1998

[51] Int. Cl.[7] ..... E04B 1/18

[52] U.S. Cl. ..... 52/92.1; 52/90.1; 52/241; 52/475.1; 52/780

[58] Field of Search ..... 52/92.1, 90.1, 52/241, 475.1, 780, 270, 282.3, 284, 781; 403/363, 381, 403

[56] References Cited

U.S. PATENT DOCUMENTS

| | | | |
|---|---|---|---|
| 3,312,018 | 4/1967 | Fourmanoit | 52/92.1 |
| 3,798,852 | 3/1974 | Nicoll, Jr. | 52/90 |
| 3,800,485 | 4/1974 | Yates | 52/90 |
| 3,808,755 | 5/1974 | Bott | 52/90.1 |
| 4,122,639 | 10/1978 | Barrell | 52/90 |
| 4,756,127 | 7/1988 | Helterbrand et al. | 52/90 |
| 5,245,803 | 9/1993 | Haag | 52/92.1 X |

FOREIGN PATENT DOCUMENTS

| | | | |
|---|---|---|---|
| 1001886 | 2/1957 | France | 52/90.1 |
| 539604 | 2/1957 | Italy | 52/90.1 |

*Primary Examiner*—Carl D. Friedman
*Assistant Examiner*—Phi Dieu Tran A

[57] ABSTRACT

A novel light building assembly system using construction panels is described. Fiber board panel is described as a preferred material. A pre-assembled low-sloped roofing system is joined to a pre-assembled wall system by use of a pre-manufactured PVC vinyl extrusion. The extrusion is installed on top of the wall system and secured by use of adhesive. Once installed the extrusion acts as a stiffener and alignment member for the walls and becomes a locking system for the roofing panels which are also secured by use of adhesive.

16 Claims, 3 Drawing Sheets

LIGHT BUILDING ASSEMBLY SYSTEM

FIELD OF INVENTION

This invention relates generally to a new and novel construction of buildings. In particular, it is directed to a new assembly technique of walls and roofs of buildings which are easy to erect yet quite sturdy and strong.

BACKGROUND OF INVENTION

Reinforced, corrugated paper board sheet material has been employed in the construction of various types of buildings in recent years, taking form of roof and side panels having structural rigidity and capable of sustaining normal loads. This has resulted in the construction of buildings formed almost entirely of paper board panels without the necessity of conventional metal or wood frames allowing on site erection or assembly of prefabricated modular sections premanufactured at factories remote from the building site.

U.S. Pat. No. 3,798,852 Mar. 26, 1974 Nicoll, Jr. describes a building constructed of precut, foldable, site erected waterproof and weather proof fiberglass reinforced, resin treated, paper board panels in the form of triangular roof trusses and rectangular end and side panels fastened in serial abutting fashion.

U.S. Pat. No. 3,800,485 Apr. 2, 1974 Yates is directed to a building roof structure made of paper board material. The structure is formed of a series of modular sections or trusses assembled to support or form a cover over a building area. Each section or truss is formed of a sheet of relatively heavy paper board having a planar surface, with downturned opposite flanges at the edges thereof.

U.S. Pat. No. 4,122,639 Oct. 31, 1978 Barrell describes a building constructed from precut and scored sheets which are folded into panels and used for both the side walls and roof. The patent specifically teaches the roof construction, the anchoring of the side walls to the footing and construction of the double panel window sill.

In all these earlier constructions of paperboard buildings, various sections are assembled together and secured by using special anchor ties, clamps and fasteners. In some cases, wooden beams are used on which paper boards are nailed or secured by metal fasteners. Although glues and adhesives are mentioned in some patents, they are used in connections with fasteners or nails.

The invention is directed to light panel building construction in which no mechanical fasteners, clamps, ties, nails are used to assemble together light construction panel sections, such as paper board, fiber board, plastic board, etc. Instead, specially designed tracks are used to put two or more sections together. Adhesive is applied the tracks so that when a panel section is inserted, a very firm anchorage is obtained. Tracks are used between the roof section and the wall section and between the footing and the wall section.

In typical construction of low cost buildings such as temporary shelters, sheds, shacks etc., connecting the roof system to the wall system always poses problem. Roofs often disconnect from the wall top plate of structures during a degree of high wind, due to an insufficient fastening system. The invention proposes the use of tracks which provide very strong locking mechanism of the two or more sections and yet it also provide very easy erection by any unskilled persons at any building site.

OBJECTS OF INVENTION

It is therefore an object of the invention to provide a light building system which is easy to assemble and yet possesses structural strength to withstand natural elements.

It is another object of the invention to provide means to securely assemble various sections of a building made of light weight construction panels.

It is a further object of the invention to provide means to securely assemble various sections of a building made of knock down components.

It is yet a further object of the invention to provide a novel mechanism to connect together the roof section and wall section, both sections made of light weight building material.

It is still an object of the invention to provide a preformed track which has a slot into which a construction panel section is tightly inserted and secured with adhesive.

SUMMARY OF INVENTION

Briefly stated, the invention is directed to a building structure which comprises wall sections having two precut and prescored mutually parallel construction panels and spacers therebetween to maintain the panels apart from one another with a predetermined distance to obtain a desired thickness of a wall section. The building structure further includes roof sections having precut and prescored construction panels and a track system having grooves to each of which a construction panel of the wall sections and the roof sections is snugly inserted and securely tied with adhesive.

In accordance with another aspect, the invention is directed to a building structure kit which comprises wall sections, each having two precut and prescored mutually parallel construction panels and a spacer therebetween to maintain the two panels apart from one another with a predetermined distance to obtain a desired thickness of the wall section. The kit further includes roof sections having precut and prescored construction panels and track systems, each having grooves of the size and shape corresponding to those of a construction panel of the wall sections and the roof sections so that when erected and applied with adhesive, the construction panels are snugly inserted and securely tied in the respective grooves.

DETAILED DESCRIPTION OF PREFERRED EMBODIMENTS OF INVENTION

Figure 1:
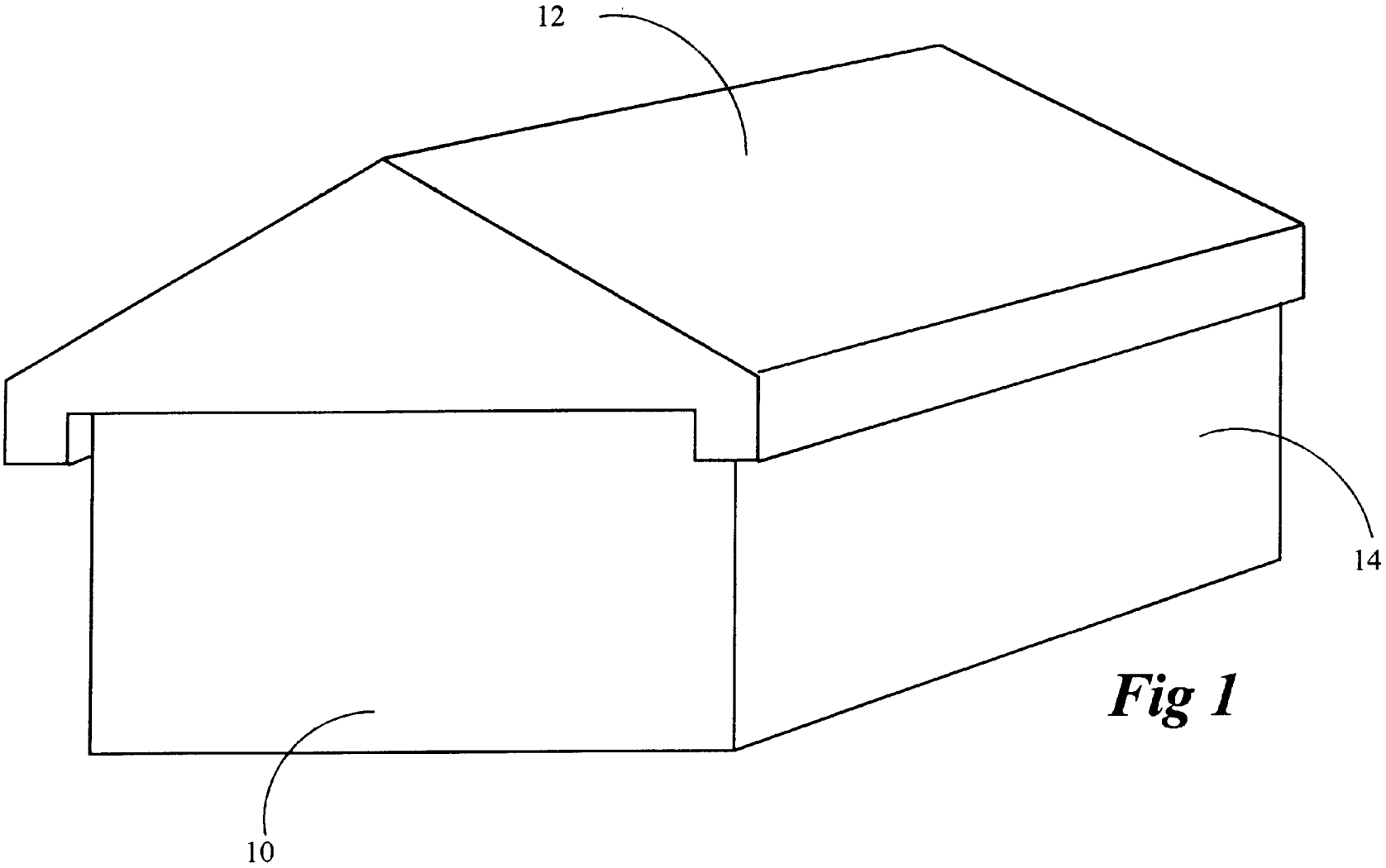
FIG. 1 is a perspective illustration of a house constructed by panel sections assembled together according to an embodiment of the invention.

FIG. 1 shows a house 10 constructed according to one embodiment of the invention. The house, e.g. a temporary shelter, etc., has a gabled roof 12 positioned on top of the side walls 14. The side walls and roof section including facia and soffit are all made of precut and prescored construction panels which are made of several glued layers of corrugated paper boards. The roof may also contain roof trusses also made of a paper board panels which may have vent holes for proper ventilation between the roof and ceiling. According to one embodiment, the roofs and walls and other joints are tied together by a locking system without the use of mechanical fasteners. The locking system employs specially designed rigid PVC vinyl extrusions, hereinafter called tracks. The construction panels of the wall sections are inserted into a PVC track secured to a floor i.e. (concrete, wood, steel) by use of adhesive and/or mechanical fasteners. The mechanical fasteners are anchored to the floor. The walls are secured into the track by use of adhesive.

Figure 2:
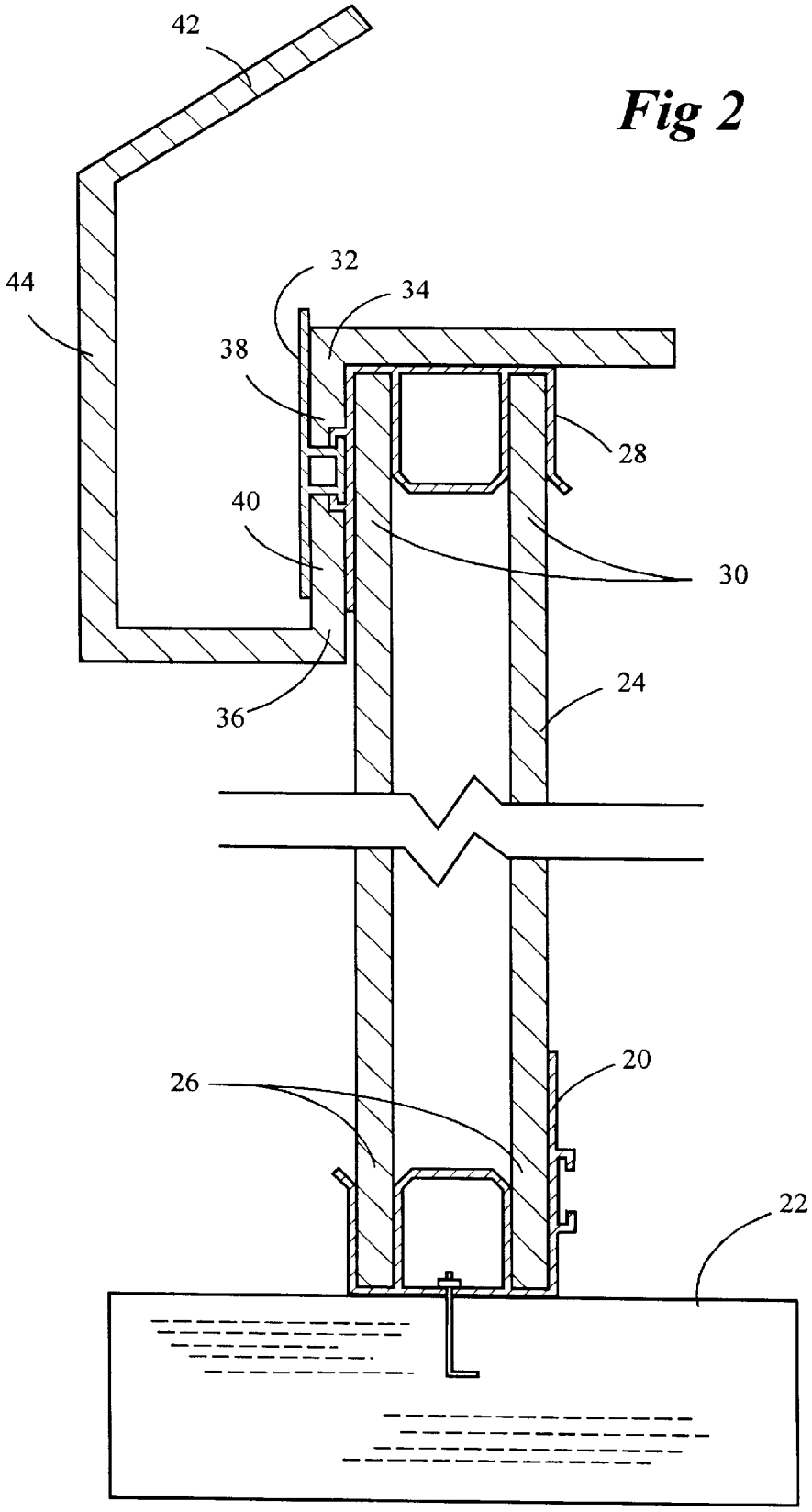
FIG. 2 is a cross sectional view of the roof section and the wall section, showing in detail the locking mechanism according to one embodiment of the invention.

FIG. 2 shows in detail the cross sectional view of a side wall and a part of the roof section. The figure shows properly assembled roof section, wall section and the floor by the use of tracks. Once installed the tracks act as a stiffener and alignment member for the walls and becomes a locking system for the roofing panels which are also secured by use of adhesive.

The PVC track 20 is secured to a base (floor) 22. The 4⅝" thick wall section 24 is inserted into the 2 pre-formed grooves 26 of the track 20. Each wall section is made of two paper board panels with a spacer between them to make the thickness of the wall 4⅝ inches. The space can be filled with insulation or can be used to accommodate variety of hidden household necessity. The wall section is secured with adhesive into the bottom track. The same track (a mirror image of the bottom track) 28 is inverted and placed on top of the walls by inserting the wall into the 2 pre-formed grooves 30 of the track 28. Adhesive is also used to secure the top track to the wall section. A wing 32 is added to the outside face of the top track by inserting the top and bottom tongue of the wing into the top and bottom groove of the track. The construction of the wing and tongues will be described later in connections with FIG. 3. Therefore, the top and bottom tracks are one and the same except that the top track has an added wing, which creates two grooves on the outer side of the wall. After the wing has been inserted, the space created 34 and 36 is used to house the ceiling lip 38 and the roof lip 40. Each roof section 42 is placed into position on top of the 4⅝" wide top track and secured by use of adhesive. The ceiling lip 38 is turned 90 degree down vertically and inserted into groove 34 and secured with adhesive. The roof panel 44 is turned vertically down 75 degrees or thereabout to create a fascia panel, then turned 90 degrees horizontally back toward the building to create a soffit, then vertically 90 degrees. The vertical roof lip 40 locks into groove 36 and is secured by use of adhesive.

Figure 3:
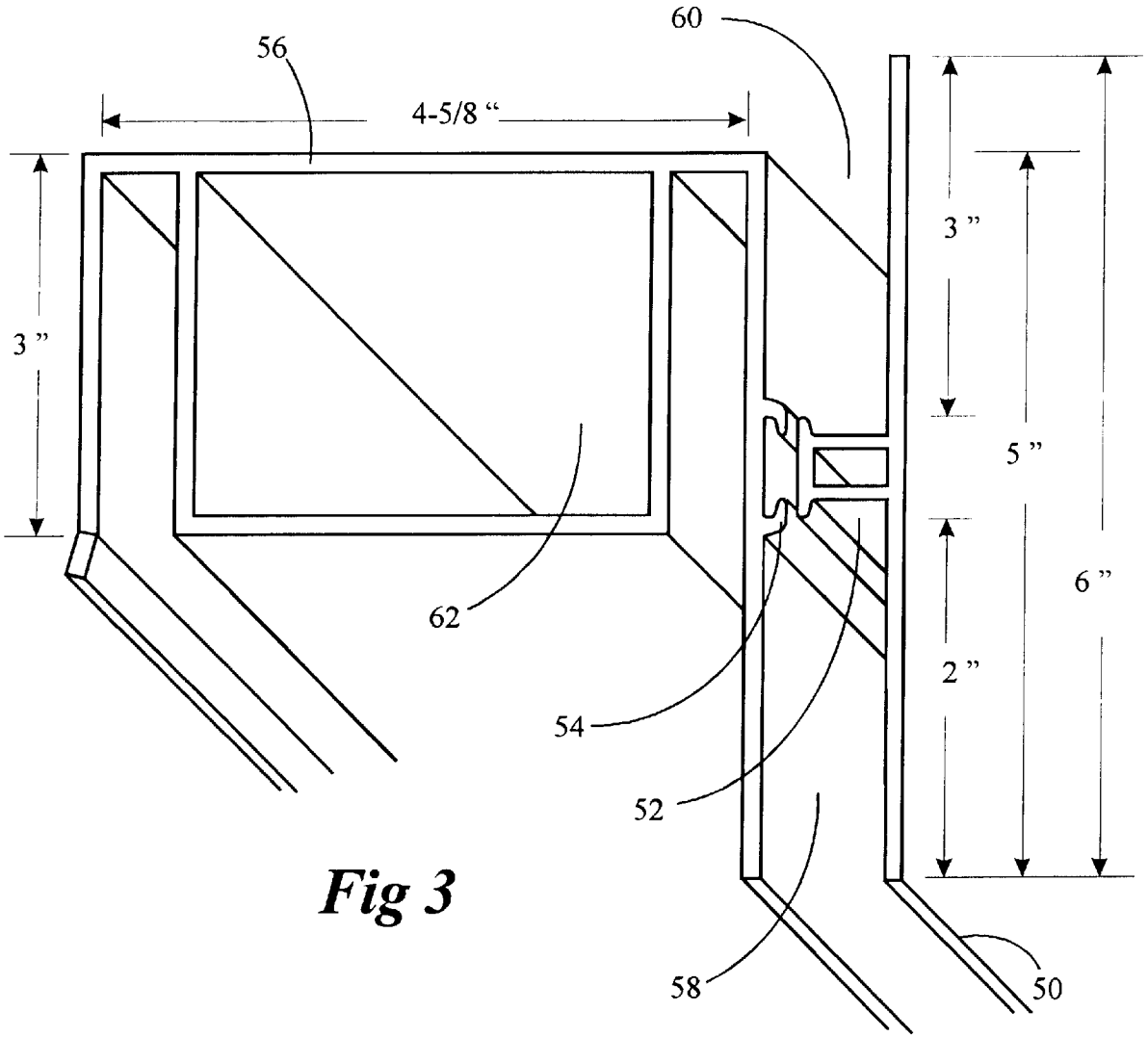
FIG. 3 is a perspective view of a track and an attachment for roof anchoring hereinafter called a wing, according to an embodiment of the invention.

Referring to FIG. 3, a track and a wing are shown in detail. The tracks are made of extruded PVC. Although other construction material can be used, the costs are important consideration besides ease of handling, durability, aesthetic nature and other factors. PVC appears to be a suitable material. As mentioned earlier, the same track is used at the bottom as well as at the top of the wall section. The bottom track is to secure the wall sections and ultimately all the building structure securely anchored to the floor or foundation. The top track has a wing attached to it to securely join the roof section and the wall section. As seen the in FIG. 3, the wing 50 is attachable by means of tongue 52 and grooves 54 to the track 56. The space 58 and 60 created between the wing and the track is used to accept the roof lip and ceiling lip so that the roof structure are securely tied to the wall section. The inner space 62 of the track can be used for variety of purposes, such as plumbing, electrical wires to name a few. It should also be noted that measurements shown in the figure is examples only and other appropriate sizes and shapes are possible.

Preferred embodiments thus far described use paper board. The paper board is also called fiberboard or cardboard. A panel is made of multiple plies of corrugated cardboard glued together in a specific directions. The exterior and interior fiberboard should be appropriately treated. For example, the roof board is water proofed and vinyl coated. The exterior wall panel is water proofed, UV proofed, acid rain proofed and coated with insect and rodent resistant exterior coating. The interior side of the wall is moisture proofed and is treated with an interior fire coat over vapour barrier. It is of course obvious that light weight construction panel which has been precut or prescored can be used in the track system of the invention. Such panels include light weight ply wood, plastics, and other construction board.

The connecting member has to be engineered in size, dimension and weight to withstand the load transfer that will be carried through it from the roof, down onto the wall and to the ground as well as the load transfer down the gable, through the wall and to the ground. The connecting piece also has to withstand roof uplift (pulling) caused by winds traveling up and over the building and pushing the roof up, when winds travel through a building. These connecting pieces and tracks can also be made of a material other than extruded PVC, e.g., light metal, aluminum, other plastics etc.

What I claim as my invention is:

1. A building structure comprising:

wall sections having two precut and prescored mutually parallel construction panels and spacers therebetween to maintain the panels apart from one another with a predetermined distance to obtain a desired thickness of a wall section;

roof sections having precut and prescored construction panels; and a track system having grooves to each of which a construction panel of the wall sections and the roof sections is snugly inserted and securely tied with adhesive.

2. The building structure according to claim 1, wherein the track system is made of an extrudable material, and comprise a middle conduit section having substantially rectangle cross section of a predetermined size which substantially corresponds to the thickness of the wall section, and two extension sections integral with the conduit section forming two grooves to accommodate snugly the construction panels of the wall section.

3. The building structure according to claim 2, wherein the wall sections are positioned vertically on a floor, the building structure comprises:

a bottom track system located at the bottom of the wall sections between the wall sections and the floor so that the construction panels of the wall section are tied in the two grooves of the bottom track system securely with adhesive.

4. The building structure according to claim 3, further comprising;

a top track system located at the top of the wall sections between the wall sections and the roof section so that the construction panels of the wall section are tied in the two grooves of the top track system securely with adhesive; the top track system further having a wing attached to one of the extension sections forming additional grooves; and the construction panel of the roof section is inserted in the additional grooves and tied therewith with adhesive.

5. The building structure according to claim 4, comprising further a ceiling made of a precut and prescored construction panel and is inserted in the additional grooves and tied therewith with adhesive.

6. The building structure according to claim 4, wherein one of the extension sections has catches and the wing has tongues so that the wing is attached by engaging the catches and the tongues.

7. The building structure according to claim 4, wherein the construction panels of the wall sections, roof section and ceiling section are made of multiple layers of treated corrugated fiber board.

8. The building structure according to claim 7, wherein the extrudable material includes any one of the followings, PVC, plastics, aluminum and light weight metal.

9. A building structure kit comprising:

wall sections, each having two precut and prescored mutually parallel construction panels and a spacer therebetween to maintain the two panels apart from one another with a predetermined distance to obtain a desired thickness of the wall section;

roof sections having precut and prescored construction panels; and track systems, each having grooves of the size and shape corresponding to those of a construction panel of the wall sections and the roof sections so that when erected and applied with adhesive, the construction panels are snugly inserted and securely tied in the respective grooves.

10. The building structure kit, according to claim 9 further comprising:

a ceiling sections made of precut and prescored construction panels.

11. The building structure kit according to claim 10 wherein the construction panels of the ceiling section are prescored for folding in a predetermined patterns.

12. The building structure kit according to claim 11 wherein the construction panels of the wall sections, roof section and ceiling section are made of multiples layers of treated corrugated fiber board.

13. The building structure kit according to claim 12 wherein the track systems are made of extruded PVC, plastics, aluminum or light weight metal.

14. The building structure kit according to claim 9 wherein the construction panels of the wall sections and roof sections are prescored for folding in a predetermined pattern.

15. The building structure kit according to claim 14 wherein the construction panels of the wall sections, roof section and ceiling section are made of multiples layers of treated corrugated fiber board.

16. The building structure kit according to claim 15 wherein the track systems are made of extruded PVC, plastics, aluminum or light weight metal.

* * * * *